United States Patent [19]

Haug

[11] 3,950,954

[45] Apr. 20, 1976

[54] METHOD AND APPARATUS FOR APPLYING LOADS TO PILES DRIVEN UNDER WATER

[75] Inventor: Stanley C. Haug, Brooklyn, N.Y.

[73] Assignee: Raymond International, Inc.

[22] Filed: Dec. 20, 1974

[21] Appl. No.: 535,084

[52] U.S. Cl. ..... 61/53.5; 61/46.5; 61/63

[51] Int. Cl.[2] ..... E02D 7/20; E02B 17/00

[58] Field of Search ..... 61/46.5, 46, 63, 53.5; 73/84; 173/2

[56] References Cited

UNITED STATES PATENTS

| | | | |
|---|---|---|---|
| 2,877,629 | 3/1959 | DeLong et al. | 61/46.5 |
| 2,976,693 | 3/1961 | Showalter et al. | 61/46.5 |

*Primary Examiner*—Jacob Shapiro
*Attorney, Agent, or Firm*—Fitzpatrick, Cella, Harper & Scinto

[57] ABSTRACT

A pile loading system for piles which are driven into the earth under a body of water wherein a buoyant vessel such as a barge or system of barges, is pinned to at least one spud positioned in the earth below the water and a rigid jacking frame is mounted on the vessel to extend above a pile. The vessel is ballasted, as by flooding, to impose a compressive load on the spud and a jack is then positioned between the pile and the frame and is actuated to transfer the load from the spud to the pile. The load may be applied for the purpose of testing the pile or for driving it further into the earth.

12 Claims, 12 Drawing Figures

31
51
30
51
33
35
60
57
58
50
34
48
43
50
44
47
45
46
42

METHOD AND APPARATUS FOR APPLYING LOADS TO PILES DRIVEN UNDER WATER

BACKGROUND OF THE INVENTION

1. Field of the Invention

This invention relates to the loading of piles and more particularly it concerns novel techniques and apparatus for load testing and driving of piles into the earth under a body of water. Such piles are used, for example, to support piers, docks, bulkheads etc. Load testing of a pile involves the maintenance of a heavy weight on the top of the pile for a predetermined length of time during which the pile is monitored for downward movement. The load testing serves to indicate whether the pile as driven will be capable of supporting the load for which it has been designed. If the pile is not capable of supporting the load, it may be driven further to increase its load carrying ability.

2. Description of the Prior Art

Load testing and driving of piles into the earth under a body of water has previously been awkward and time consuming. In general, these techniques were carried out by driving a plurality of support piles adjacent the pile to be loaded for driving or testing. A platform was then constructed on the support piles to extend over the pile to be loaded; and a jack was positioned between the top of the pile and the load platform. When the jack was operated it would impose an upward force on the platform and the support piles while pushing downwardly on the pile being loaded.

These prior art arrangements presented several problems. If the pile was being tested for load carrying capacity and it began to settle, the load platform would have to be dismantled before the pile could be driven into the earth. Then, in order to retest the pile at its new height, it was often necessary to drive each support pile further into the earth to bring the load platform down to the new level of the top of the test pile. Also, the prior art pile loading structures could not be moved easily from one pile to another.

SUMMARY OF THE INVENTION

The present invention avoids the above described problems of the prior art by means of novel arrangements which permit loading of piles driven under water with a minimal amount of equipment and with a minimum time loss due to loading apparatus disassembly when the pile must be redriven or when a different pile is to be loaded.

According to one aspect of the present invention, a pile is loaded for driving or testing by pinning a floating vessel, such as a barge, to one or more support spuds driven near the pile, ballasting the vessel (e.g. by pumping water into it) to impose a compressive load on the support spuds, affixing a rigid frame to the vessel which extends over the top of the pile and then applying a jacking force between the top of the pile and the rigid frame to transfer the compressive load from the support spud to the pile. The support spuds may be driven from the vessel itself.

In preparing the loading system a load is chosen which is greater than that to be applied to the pile. The amount of this load can be varied by controlling the amount by which the vessel is flooded; and where the flooding capacity of a single barge is inadequate, several barge units may be coupled together to form a barge system of any desired loading capacity.

A rigid frame assembly is provided with the vessel to extend over the top of a pile during the loading operation. This rigid frame assembly includes a plurality of vertical support members attached at their lower ends to the vessel; and it further includes a jacking frame attached to the upper ends of the support members.

This arrangement permits close control of the load applied to the pile; and it also provides flexibility in that the frame assembly is readily adjusted to various heights without need for lifting the load from the vessel. Also, when several barges are used, they may readily be moved from one pile site to another merely by floating them, either assembled or unassembled.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that this invention may be utilized as a bases for the designing of other structures or methods for carrying out the several purposes of this invention. It is therefore important that the claims be regarded as including such equivalent constructions and methods as do not depart from the spirit and scope of the invention.

BRIEF DESCRIPTION OF THE DRAWINGS

One embodiment of the invention has been chosen for purposes of illustration and description, and is shown in the accompanying drawings forming a part of the specification, wherein.

DETAILED DESCRIPTION OF THE PREFERRED EMBODIMENT

Figure 1:
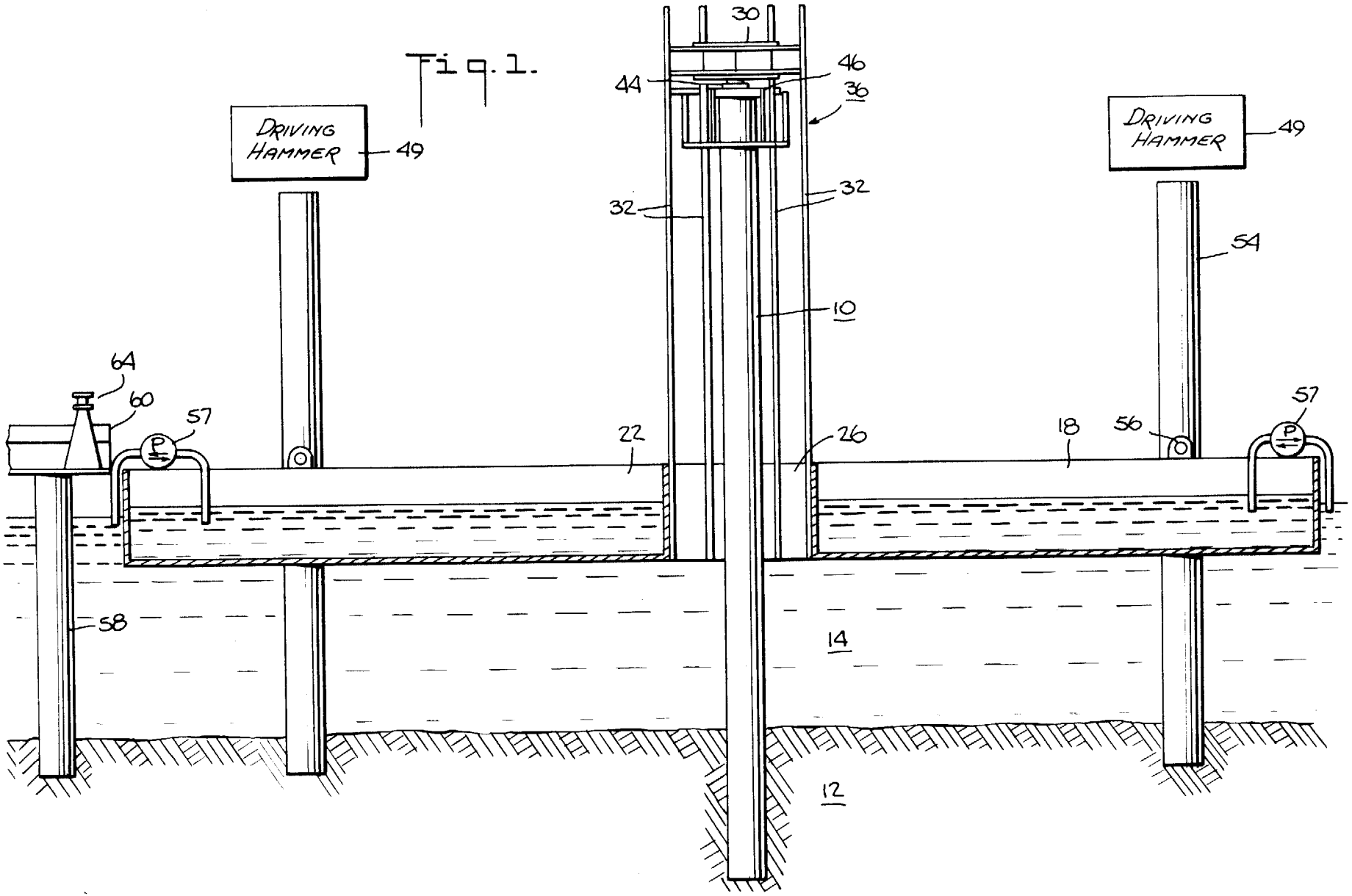
FIG. 1 is a side elevation view, partly in section, of a load testing system in which the present invention is embodied.
Figure 2:
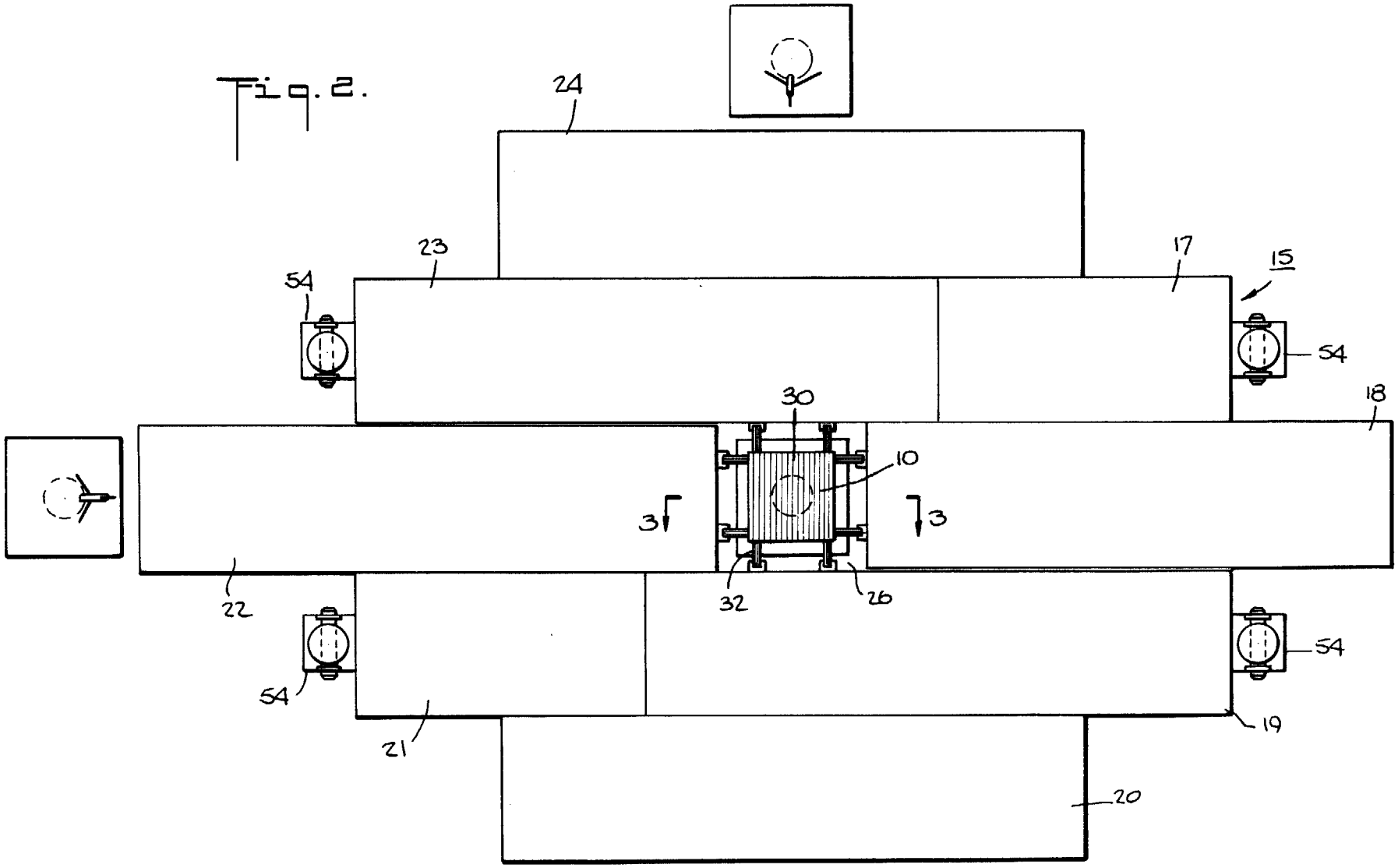
FIG. 2 is a top plan view of the load testing system of FIG. 1.

FIGS. 1 and 2 show a test pile 10 which has been driven into the earth 12 under a body of water 14. The pile is subjected to a load test by applying a predetermined downward force, or load, to the top of the pile for a predetermined duration and measuring the amount by which the test pile settles in that direction.

In order to provide this predetermined downward force, there is provided, according to the present invention, a test barge system 15 positioned adjacent the test pile 10. This system may include a number of individual barge units 17–24 rigidly coupled together. Preferably the barge units are shaped and arranged to surround the test pile 10 and to define a central opening 26 down through which the test pile extends. A rigid jacking frame 30 is positioned on top of test pile 10 and is connected to the barge system 15 by means of vertical support members 32.

As can be seen, the vertical support members 32 are positioned about the perimeter of the central opening 26 where they are connected to barge units 18, 19, 22 and 23. The upper ends of the support members are connected to the jacking frame 30 which extends over the test pile 10. A jack 44 is interposed between a jacking platform 46 on top of the test pile 10 and the jacking frame 30. The jacking frame 30 and vertical support members 32 together constitute a rigid assembly 36 extending from the barge system and over the top of the test pile 10.

A number of spuds 54 are driven into the earth 12 alongside the test barge system 15. As can be seen, these spuds are connected to the test barge system by means of pins 56.

Spud driving hammers 49 (shown schematically) may be provided on the individual barge units to drive the various spuds 54 in place when the barge system is brought into position alongside the test pile 10. These hammers may also be used to extract the spuds upon completion of a test.

A pumping system 57 (shown schematically) is provided to bring water into and out from the barge units, thereby to control their ballast by flooding and draining. One or more level support piles 58 may also be driven into the earth near the test pile 10. These level support piles are provided with a platform 60 upon which level indicating equipment 64 is mounted. This latter equipment is used to observe any displacement of the test pile by measuring the displacement of reference markers (not shown) on the test pile 10.

Figure 6:
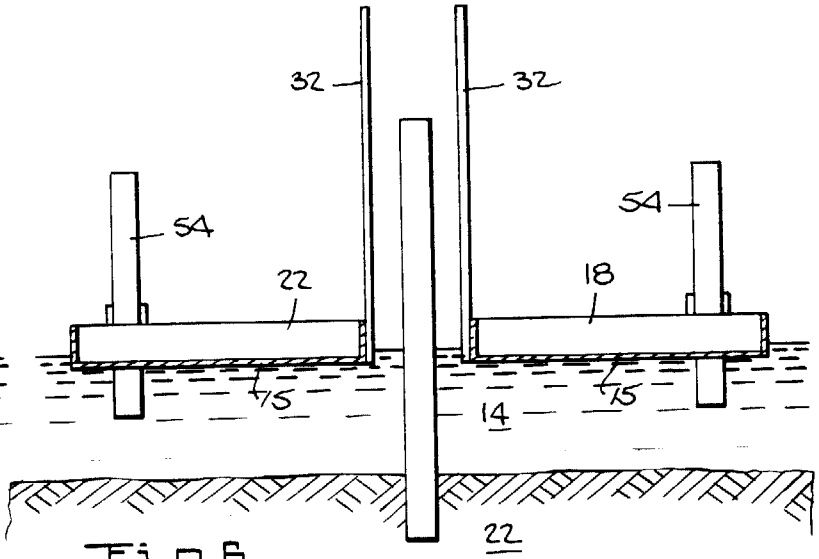
Figure 5:
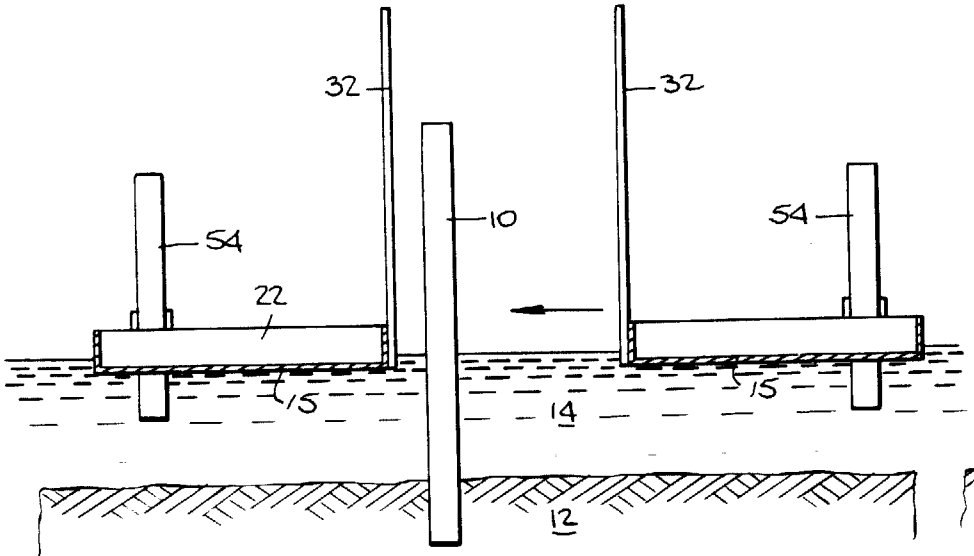

FIGS. 5–12 illustrate the sequence of operation in conducting a load test using the systems described above. As shown in FIGS. 5 & 6 several individual barge units 18 and 22 are floated into position about the test pile 10. These units carry their respective spuds 54 raised from the earth 12; and they also carry their associated vertical support members 32.

Figure 7:
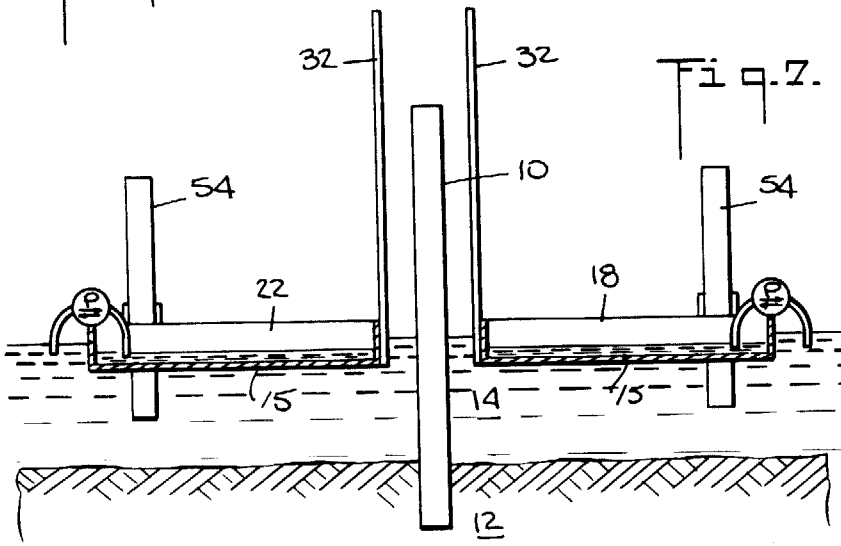
Figure 10:
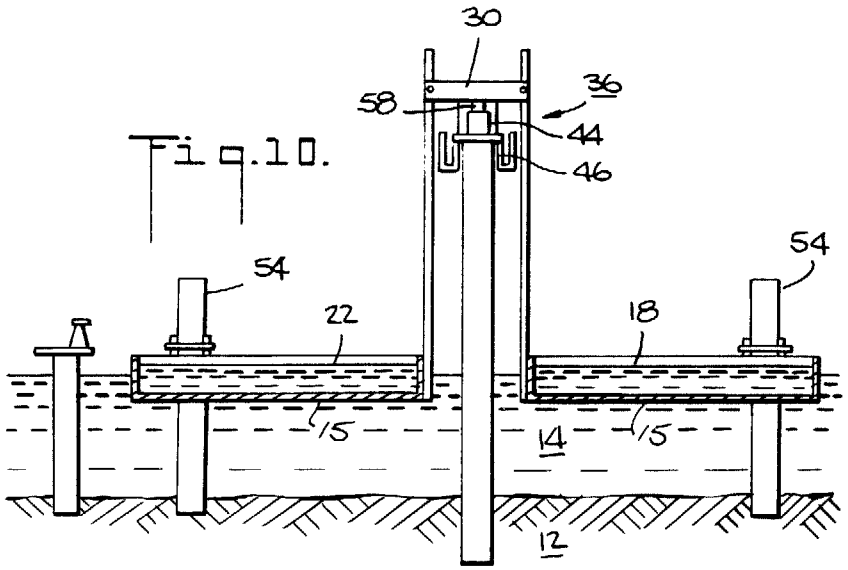

Thereafter as shown in FIG. 7, the individual barge units are coupled together to form the barge system 15. The barge system 15 may then be partially flooded by operation of the pumping system 57 as shown in FIG. 7. As will be seen, this step of partial flooding is optional.

Figure 8:
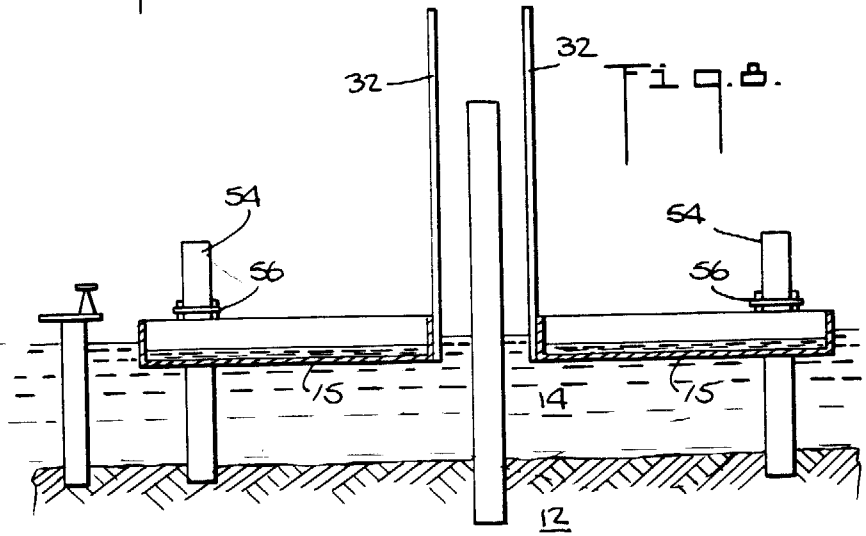
Figure 9:
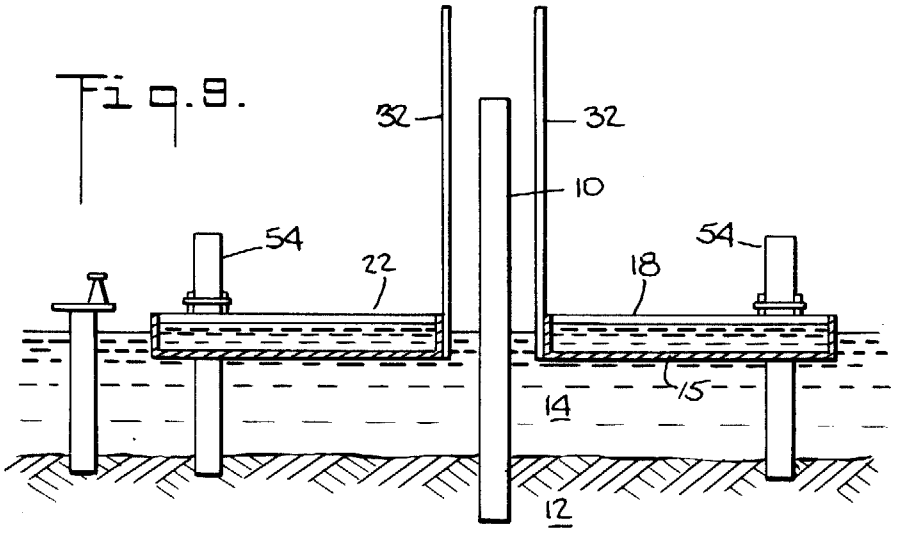

Following the placement of the barge system and partial flooding thereof, the spuds 54 are driven down into the earth 12 as shown in FIG. 8. The driven spuds are then pinned to the barge system and the pumping system is activated to flood the barge system further as shown in FIG. 9. This flooding ballasts the barge system; however because the barge system is pinned to the spuds 54 it does not sink into the water 12 but instead the weight of the additional water pumped into it is borne by the spuds 54. These spuds should cumulatively be capable of supporting the weight of additional water pumped into the barge system; and the amount of the additional water will in most cases have a total weight at least as great as the test load to be applied to the test pile 10.

Figure 11:
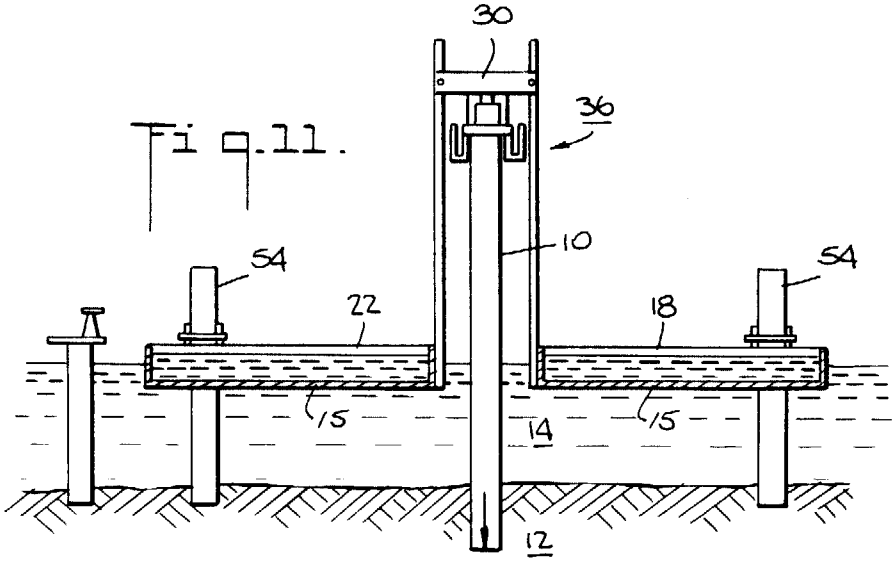

After the barge system 15 has been assembled, and either before or after the driving of the spuds 54 and the flooding of the barge system, the jacking frame 30 is mounted on the support members 32 to extend across the top of the test pile 10 as shown in FIG. 11. Also, the jack 44 and a load cell 58 are interposed serially between the jacking platform 46 and the jacking frame 30.

A load test on the test pile 10 is carried out as shown in FIG. 11 by actuating the jack 44 to push up against the frame 30 and down against the top of the test pile 10. This transfers the weight of the water laden barge system from the spuds 54 to the test pile 10. The amount of weight imposed on the test pile can, of course, be controlled by controlling the amount of jack actuation. If during the load test the test pile 10 should begin to settle, the weight of the barges will automatically revert to the spuds 54 and the load cell will show a release of stress on the pile 10.

Figure 12:
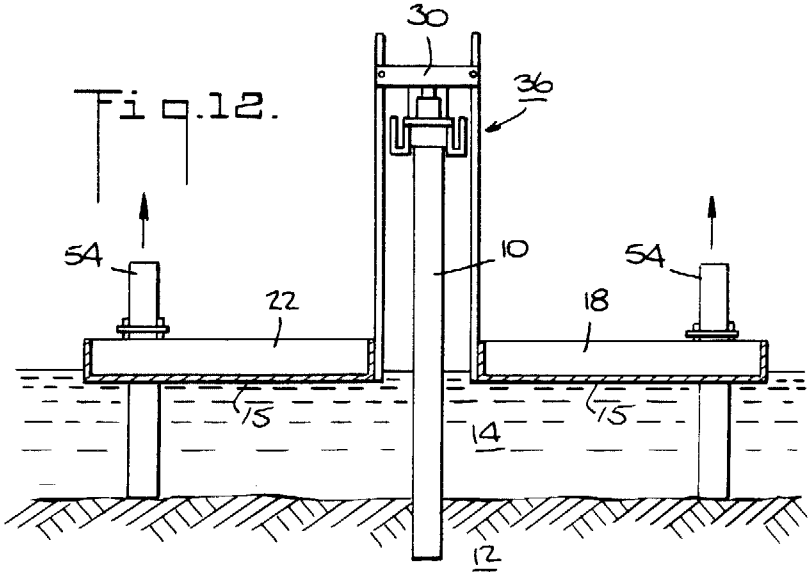

After the load test is completed, the jack 44 is deactuated and it, the load cell 58, and the frame 30, are removed. The barge system is then drained and the spuds 54 are withdrawn. If, as described above, the barge system was partially flooded prior to being pinned to the drained spuds, the removal of the spuds following a load test is facilitated by simply draining the barge system completely while leaving it pinned to the spuds. The increased buoyancy provided to the barge system by the complete draining will produce an uplift on the spuds to assist in pulling them up out of the earth as shown in FIG. 12.

Instead of preballasting the barges prior to the load test, the barges may be left unballasted until they are pinned to the spuds. Then, following the load test, after the barges have been drained, they may be unpinned, reflooded, repinned and then drained again to apply uplift load to the spuds.

Figure 3:
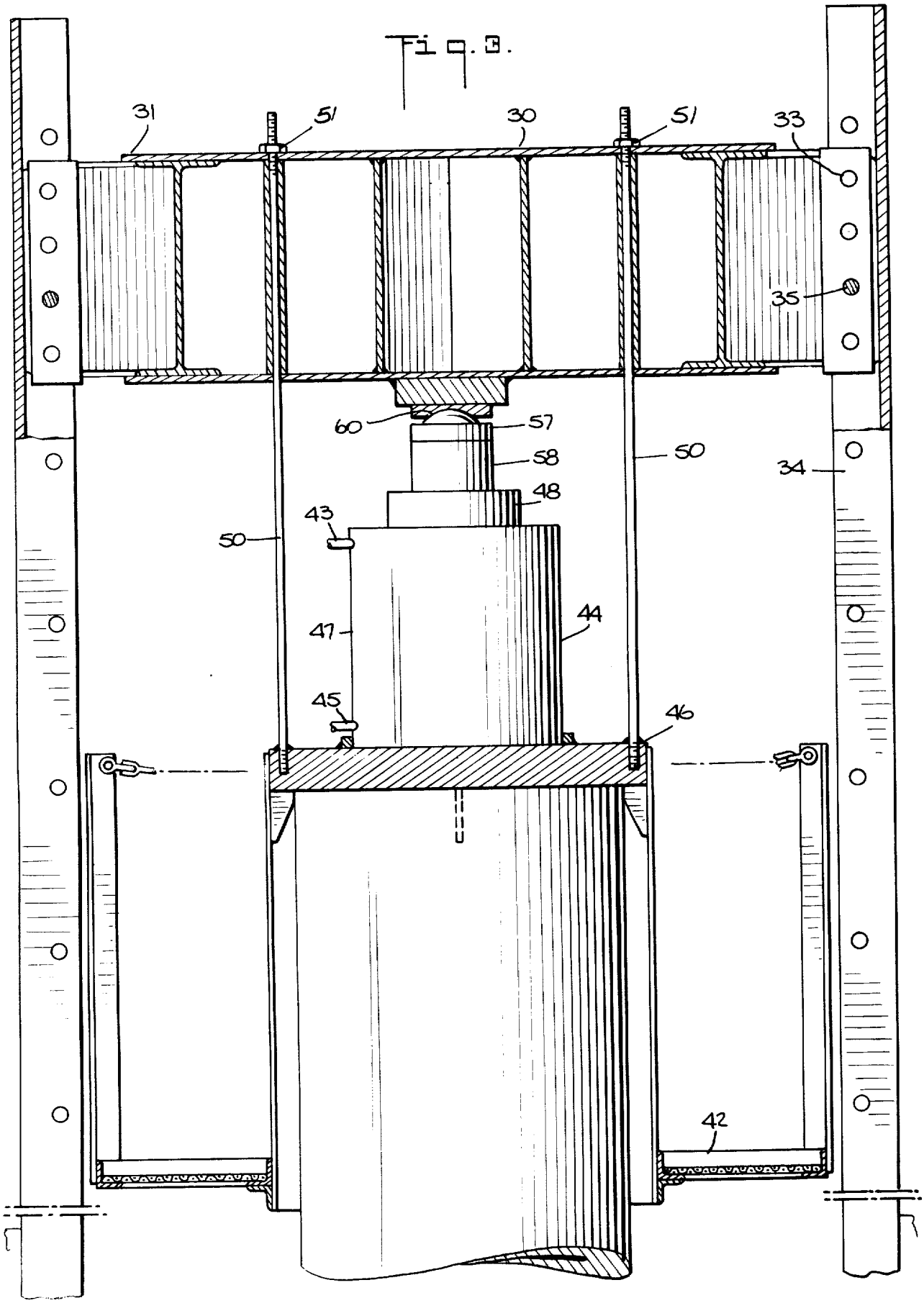
FIG. 3 is an enlarged view taken along line 3—3 of FIG. 2 and showing the jack and jacking frame.
Figure 4:
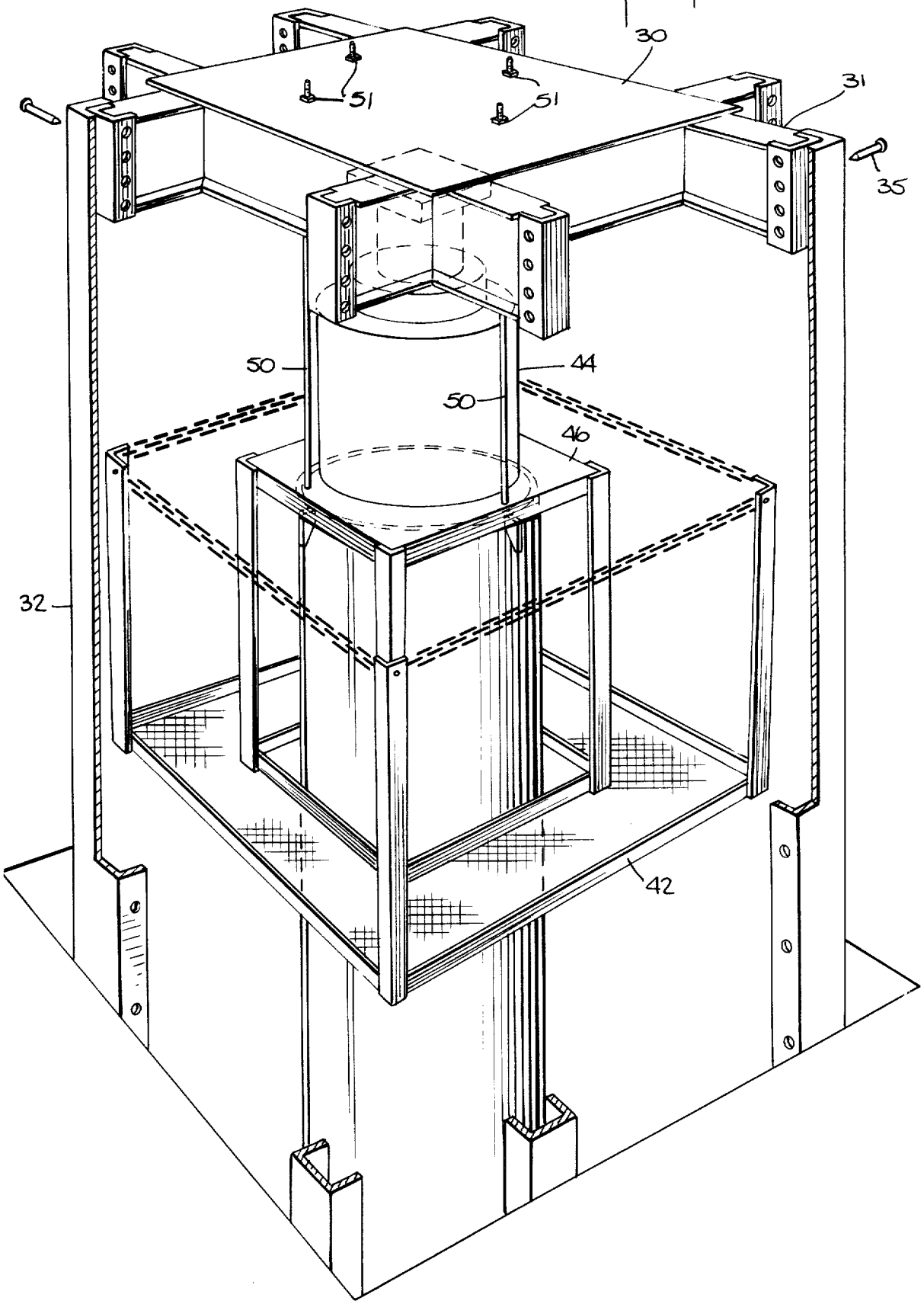
FIG. 4 is an enlarged perspective view of the assembly shown in FIG. 3, and FIGS. 5–12 are outline views in side elevation showing the assembly and operation of the load testing system of FIGS. 1–4.

As can be seen in FIGS. 3–5 jacking platform 46 is provided with a cat walk 42 which extends about the upper perimeter of the test pile 10. The platform forms a base for mounting the jack 44. The jack 44 is preferably of the hydraulic type and is provided with hydraulic lines 43 and 45 from a remote hydraulic system (not shown). The jack has a base 47 which rests on the platform 46 and a ram 48 which extends out from the base. The load cell 58 is positioned between ram 44 and spherical bearing 57 which contacts a concavity 60 formed in the lower side of the jacking frame 30.

A plurality of threaded shafts 50 are positioned between the jacking platform 46 and the jacking frame 30. These shafts permit easy assembly of the jacking assembly on the top of the test pile 10. With the shafts tightened by nuts 51 the jacking platform, jack, load cell and jacking frame are positioned on the test pile after which the nuts are loosened to permit relative movement between the jacking platform and the jacking frame. The jacking frame is then adjustably positioned on the vertical support members with a plurality of outwardly extending flanges 31. By raising the jacking frame, holes 33 drilled in these flanges are aligned with holes 34 drilled along the length of vertical support members 32. A number of pins 35 are then used to fasten the jacking frame to the supports and the rigid frame 36 is then completely assembled.

With the above arrangement the rigid frame is easily assembled above the test pile and can quickly be lowered to a second operating position in the event the pile 10 has to be driven further following the first load test.

While the foregoing description relates to the testing of piles, it will be understood that the same apparatus and method may be employed to drive piles. In such case the load cell 58 may be omitted.

Having thus described the invention with particular reference to the preferred form thereof, it will be obvious to those skilled in the art to which the invention pertains that various changes and modifications may be made therein without departing from the spirit and scope of the invention as defined by the claims appended hereto.

What is claimed and desired to be secured by Letters Patent is:

1. Apparatus for loading piles driven into the earth under water, said apparatus comprising a buoyant vessel, at least one spud driven into the earth adjacent said vessel, means on said vessel for pinning said vessel to said driven spud, a rigid assembly secured to said vessel and extending out therefrom to be brought into position over a pile to be loaded, means for variably adjusting the buoyancy of said vessel to impose a variable load on said spud and load transfer means to shift said variable load imposed by said vessel from said spud to said pile.

2. Pile loading apparatus according to claim 1, wherein said load transfer means includes a jack positioned to push upwardly against said rigid assembly and downwardly against the top of a pile to be loaded.

3. Pile loading apparatus according to claim 2, wherein said rigid assembly comprises a plurality of vertical support members connected to extend upwardly from said vessel and a jacking frame connected to said support members to extend over the top of a pile to be loaded.

4. Pile loading apparatus according to claim 3, wherein said jack is a hydraulic jack.

5. Pile loading apparatus according to claim 3, wherein a load sensing cell is positioned in series with said jack and said jacking frame.

6. Pile loading apparatus according to claim 1, wherein said vessel comprises a plurality of disconnectable barge units connected rigidly together.

7. Pile loading apparatus according to claim 1, wherein a plurality of spuds are driven into the earth adjacent said vessel.

8. A method for loading a pile driven into the earth under water, said method comprising the steps of floating a vessel to a position near the pile, driving at least one spud into the earth adjacent the vessel, fastening said vessel to the driven spud, flooding the vessel to ballast it while it is pinned to the driven spud to impose a compressive load on the spud, affixing a rigid frame on the vessel to extend over the pile and applying a jacking force between the top of the pile and the rigid frame to transfer the compressive load from the spud to the pile.

9. A method according to claim 8, wherein the compressive load on said spud is at least as great as the load which is transferred to the pile.

10. A method according to claim 8, wherein a plurality of spuds are driven into the earth adjacent said vessel and wherein the cummulative compressive load on the spuds is at least as great as the load which is transferred to the pile.

11. A method according to claim 8, wherein a number of barge units are rigidly secured together to form said vessel.

12. A method according to claim 8, further including the steps of at least partially flooding the vessel before fastening it to said spud to provide a preload ballast, fastening the preloaded vessel to said spud, and then removing said preload ballast to impose an uplift force on said spud to lift it up from the earth.

* * * * *